US009561930B2

(12) United States Patent
Gremley

(10) Patent No.: US 9,561,930 B2
(45) Date of Patent: Feb. 7, 2017

(54) STRING LIGHT STORAGE LATTICE

(71) Applicant: Kurt Gordon Gremley, Tampa, FL (US)

(72) Inventor: Kurt Gordon Gremley, Tampa, FL (US)

( * ) Notice: Subject to any disclaimer, the term of this patent is extended or adjusted under 35 U.S.C. 154(b) by 10 days.

(21) Appl. No.: 14/459,273

(22) Filed: Aug. 13, 2014

(65) Prior Publication Data

US 2015/0041581 A1 Feb. 12, 2015

(51) Int. Cl.

*B65H 75/06* (2006.01)
*B65H 75/20* (2006.01)
*F21V 17/00* (2006.01)

(52) U.S. Cl.

CPC ..... *B65H 75/20* (2013.01); *B65H 75/06* (2013.01); *F21S 4/10* (2016.01); *F21V 17/007* (2013.01); *B65H 2701/3915* (2013.01)

(58) Field of Classification Search

CPC . B65H 75/06; B65H 75/20; B65H 2701/3915; B65H 54/56; B65H 54/58; B65H 54/60; F21V 17/007; F21S 4/001; F21S 4/10

USPC ..... 242/613, 613.3

See application file for complete search history.

(56) References Cited

U.S. PATENT DOCUMENTS 2,287,368 A * 6/1942 Anderson ..... B65H 75/06 242/404.2
2,385,197 A * 9/1945 Eisel ..... G09B 25/00 242/388.1
3,696,918 A * 10/1972 Lerner ..... B65D 85/04 206/388
5,526,931 A * 6/1996 White ..... B65D 73/0007 206/388
5,941,388 A * 8/1999 Spielberger ..... B65D 25/107 206/419
6,450,339 B1 * 9/2002 Ashton ..... A47F 7/005 206/388
7,028,838 B1 * 4/2006 Rhoades ..... B65H 75/06 206/419
7,108,396 B2 * 9/2006 Swaris ..... G09F 13/0404 257/E25.028

* cited by examiner

*Primary Examiner* — William A Rivera

(57) ABSTRACT

The invention concerns a devise being a flat lattice frame for holding string lights, such as Christmas lights, for tangle free storage designed to fit in a standard file storage box. It is designed in a manner for easy use, helps to minimize the required storage space and to approximately match the interior of a standard file box to provide vertical support.

3 Claims, 2 Drawing Sheets

String Light Storage Lattice
Front View
See Attachment "A" for Measurement Details
1
5
10
15
A
B
C
D
E
G
H
J
K
L
M
N
O
P
Q
Rad - R
Rad - L Rotated View
String Light Storage Lattice

STRING LIGHT STORAGE LATTICE

TECHNICAL FIELD AND INDUSTRIAL APPLICATION OF THE INVENTION

The invention concerns a devise being a lattice frame for holding string lights, such as Christmas lights, for tangle free storage in a standard file storage box. It is designed in a manner that helps to minimize the required storage space and to approximately match the interior of a standard file box to provide vertical support

BACKGROUND OF THE INVENTION

Decorative string lights are typically used for seasonal displays, such as Christmas, for limited time (typically less than 60 days). The balance of the year they are they are kept in storage. Since most of the year they are in storage, it is important to have efficient storage method with a minimum wasted space. The storage factor has become more important as the actual or effective cost of storage has increased and/or the availability of storage in homes may have decreased.

Due to length and characteristics string lights can become tangled when not stored properly, which can lead to damage. Storing in an orderly manner that minimizes or eliminates the potential for becoming tangled is preferred. With the conversion to LED type string lights, which are currently more expensive than incandescent lights, preventing damage has an increased importance.

Since string lights are seasonal this means that once a year they are taken out of storage and placed back in storage, so while the process of taking out of storage and putting in storage in needs to be effective it does not have to be the primary characteristic of the storage device. For large quantities of string lights, a uniform and cost effect method of storage is desirable

SUMMARY OF THE INVENTION

This inventions provides a lattice frame for the storage of multiple string lights within a box typically used to store paper files (a "file box"). The lattice frame width ('A' is approximately fifteen inches and its height ('B') is approximately nine inches to match the standard interior dimensions of a file box for United States and would be modified for the standard size file box for other countries.

The invention is designed as a frame with four sets of lattices including corresponding cross members where each lattice can accommodate all or part of a length of string lights (depending upon the size of the bulb and the length of the string). The lattice end opening width (D) and the depth (C) combine with the distance between the two lattice openings ("F", which is also the initial winding distance) can hold a 100 mini bulb string of approximately 33 feet or a 60 bulb C6 LED string of approximately 20 feet. Longer strings can be accommodated by using more than one set of the lattices by shifting to the adjacent end opening of the lattice when wound around the lattice frame. On the interior of the lattice is an opening with a notch at either end (the notch is currently designed as curve but can be another shape). This opening serves the purpose of acting as a handle while winding the light string. A separate handle would waste space. The interior openings are sufficient for a typical size hand to hold the lattice frame and there is minimal interference between the hand and the light string during the winding of the last string on the lattice.

The notch holds a plug end (male or female) of the light string to initially hold the light string on the lattice frame at the start of the winding process. This notch is placed on interior to minimize interference that the more space critical point of contact of the light string with the exterior end of the lattice. While the notch is wider than the wire, at its widest point it is close to half width of a standard plug to allow for some movement during the winding process.

The anticipated method of use involves holding the lattice frame in one hand so the ends of the lattice are predominantly vertical and with the other hand placing the plug end is placed on the notch on the lower portion of the interior opening of one lattice while the holder gently pulls down on the string light and winds it around the selected lattice. This process is comparable to the process of winding the string on a stationary spool or reel and is an effective process of taking the light string out of storage and placing back in storage.

When the winding is completed the other string end (which usually has a plug end) is tucked under a portion of wrapped string light to secure the end. When light strings are wound on the frame lattice they are kept from becoming tangled and kept in an orderly manner.

When the lattice has been filled with string lights due to the length of the lattice frame it has elongated oval lateral shape. Since the lattice is designed to fit vertically in a file box (and will fit in many other storage containers) this shape achieves the objective of minimizing storage area over a circular storage such as reels. The lattice frame has a flat top and bottom to provide additional support to the file box and to keep weight off of the light strings. The ends of the lattice are curved since sharp square ends could result in injuries during winding, could more easily snag string lights during the winding process, catch edges of file boxes, or pierce/damage file boxes or other storage containers.

While reels or spools achieve a similar method of storage, their circular form is not an effective a shape for storage since space is lost at the spool's interior and exterior. While reels or spools that can rotate for winding process are very useful for lineal materials (such as cords or hoses) this feature is more beneficial for more durable items that are used often and are easily wound. String lights should be handled carefully.

BRIEF DESCRIPTION OF THE DRAWINGS

Figure one is the front flat perspective of the invention.

Figure two is a rotated view to provide a perspective of the depth of the inventions Attachment "A" is a detailed description of the measurement references

DETAILED DESCRIPTION OF THE INVENTION

Figure 1:
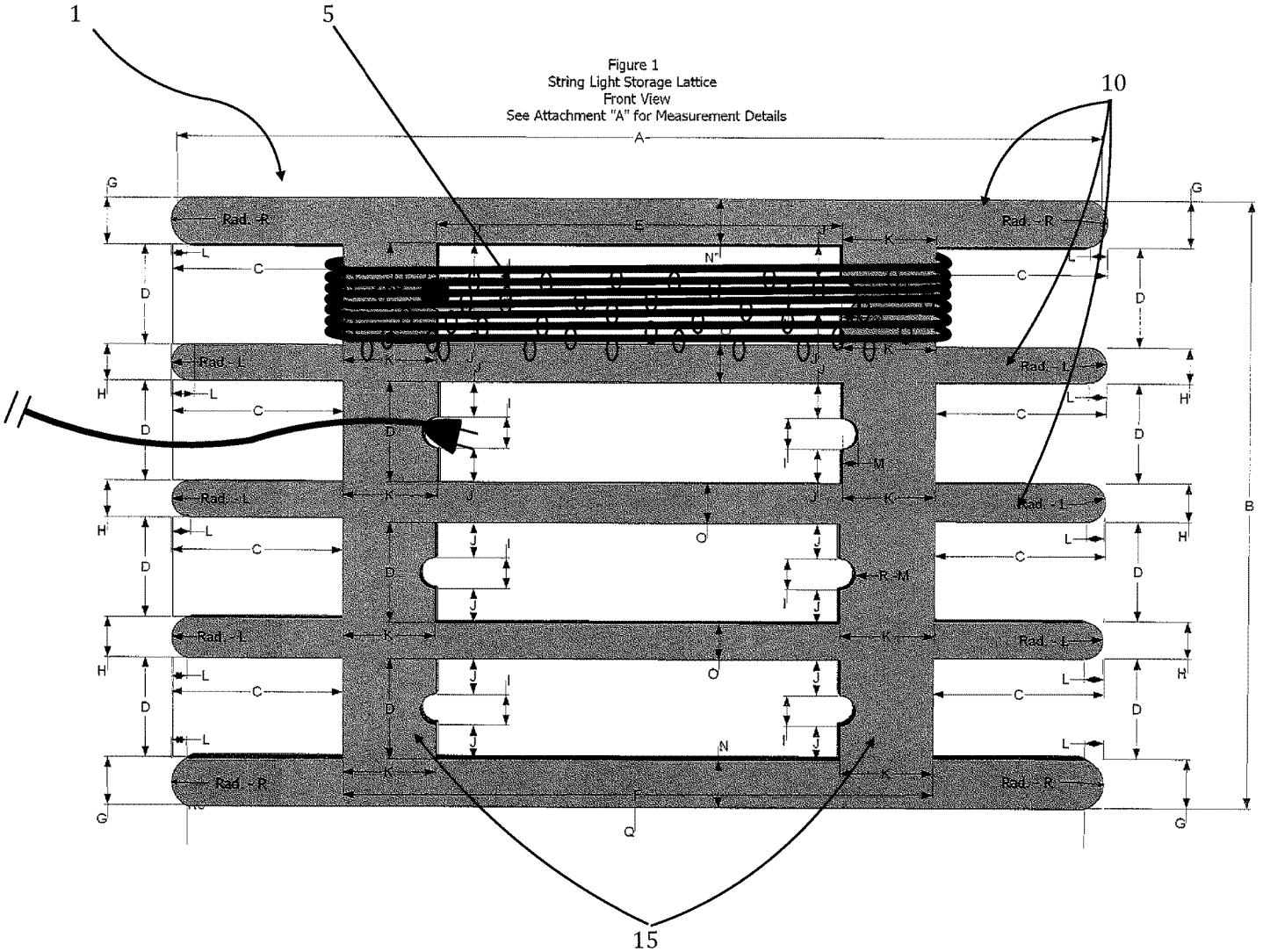
Figure 2:
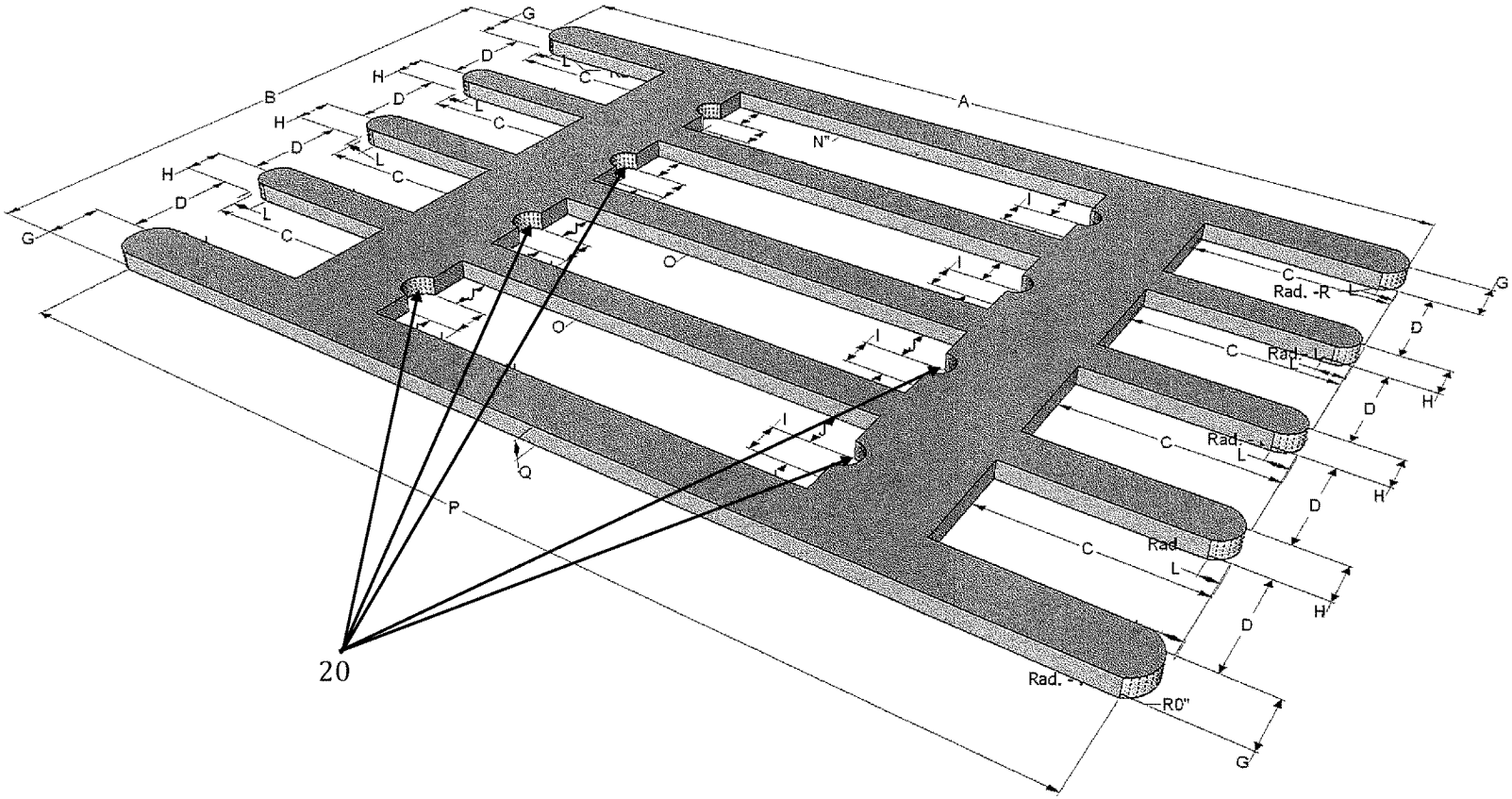

As shown in the drawing the invention s a flat thin lattice frame 1 having cross members 15 and lattice 10 to hold multiple string lights (such as those used for seasonal holiday decorations). The invention has an anticipated thickness of a quarter inch and a design length (A) of fifteen inches and height (B) of nine inches to fit vertically on the wider length of a standard file storage box. The longer width ("A") with initial winding length design of 9½ inches helps to minimize the curve associated with winding string lights around the lattice frame 1 which minimize the area not used in the storage process. The lateral nature of the lattice frame for vertical storage helps prevent pressure against the light strings and adds support when placed in a standard file box.

Attachment "A"Detailed Description of Measurement References Provided in Figures A. Overall Length of the frame lattice is to match the interior length of a standard file box. The current design is fifteen (15) inches but can be slightly shorter without impacting function and can be modified to fit standard file boxes in other countries.

B. Overall height of the frame lattice is to match the interior height of a standard file box. The current design is nine (9) inches, but can be slightly shorter without impacting function and can be modified to fit standard file boxes in other countries.

C. The depth of the end opening of the frame lattice is designed to be two and three quarters (2¾) inches to provide enough depth to the opening so that many typical strings will fit on the lattice without, but variations +/− of a half inch will not substantively impact function and may be modified to address consumer preferences.

D. The width of the end opening of the frame lattice is designed to be one and five eights (1⅝) inches to provide sufficient width for most standard string lights 5 and to provide four uniform openings not to exceed the height of a standard file box and provide sufficient width of the frame lattice to withstand the strains of use and storage.

E. The width of the interior opening of the frame lattice is designed to be one and five eights (1⅝) inches to provide for sufficient room to act as a handle, as well as match the exterior width to simplify manufacturing and be more visually appealing.

F. The width between the end opening of the frame lattice is designed to be nine and one half (9½) inches to maximize the winding length for the string ling without impacted the depth of the end opening and not exceeding the length of a standard file box.

G. The width of the top and bottom lattice of the frame lattice is designed for one half (½) inch and is slightly thicker than the width of the other lattices in anticipation that it will be stored in a standard file box. The additional width it to provide stronger support and help prevent collapsing of the file box.

H. The width of the three interior lattices is designed to five eights (⅝) of an inch to have sufficient strength to withstand typical use and storage, but can be slightly modified without impacting function.

I. The width of the interior notch 20 is designed to be one half (½) inch to allow for sufficient lateral movement of the plug end during the winding process and is narrow enough to hold a typical plug end but can be slightly shorter without impacting function and can be modified to accommodate the associated electric plugs used in other countries.

J. The distance between the notch and the edge of the interior opening is nine sixteenths (9/16) inch as the result of other designed factors.

K. Is primary width of the vertical lattice of the frame lattice and is designed to be 1½ inches and functions as the vertical support of the frame lattice. While this width is a function of the end opening depth ('C') and the interior opening ('E') this portion can act as a structural element since it can help brace the top and bottom of the file box. The width can be slightly shorter without impacting function.

L. Is the distance from the end of the lattice frame to the end of the curve end and is currently designed for five sixteenths (5/26) of an inch and is the same for all lattices for appearance purposes. Is the nine sixteenths (9/16) inch.

M. The depth of the interior notch is designed to be is the nine sixteenths (9/16) inch to allow for area to hold the plug end during the winding process and but not so deep to interfere with the winding\unwinding process or impact the strength of the vertical lattice (with width "K"). The depth can be slightly shorter without impacting function.

N. Is to confirm that the lattice has the same width the entire length to simplify manufacture and be more visually appealing.

O. Is to confirm that the lattice has the same width the entire length to simplify manufacture and be more visually appealing.

P. This is the distance between the two curved ends as the result of other designed factors.

Q. The thickness of the frame lattice is designed to be one quarter (¼) inch to provide sufficient rigidness in anticipation that the frame lattice will be made of a stiff plastic. This thickness may be modified depending on the characteristics of the material used to manufacture the lattice frame.

I claim:

1. A device for storing string lights comprising:

a. a frame, wherein the frame comprises:

i. at least two cross members opposite one another, the at least two cross members having a plurality of notches on an interior surface of each of the at least two cross members, wherein the interior surface of each of the at least two cross members face one another, wherein the plurality of notches extend into the interior surface of each one of the at least two cross members;

ii. a plurality of lattice members extending between the at least two cross members, wherein the plurality of lattice members have a first end and a second end, wherein the first end extends beyond one of the at least two cross members, and wherein the second end extends beyond another one of the at least two cross members, wherein the plurality of lattice members are generally parallel with one another, wherein the at least two cross members are generally parallel with one another, and wherein an intersection of each of the plurality of lattice members and each of the at least two cross members is general perpendicular, and wherein the first end and the second end separate one or more strands of lights.

2. The device of claim 1, wherein the plurality of notches generally bisects two of the plurality of lattice members, wherein the plurality of notches are curves, wherein each of the plurality of notches is wider than the one or more strand of lights, and wherein each of the plurality of notches holds a plug end of the one or more strands of lights.

3. The device of claim 1, further comprising one or more openings defined by the interior surface of each of the at least two cross members and an interior surface of at least two of the plurality of lattice members, wherein the one or more openings is a handle.

* * * * *